United States Patent [19]

Bloemers et al.

[11] 4,392,779

[45] Jul. 12, 1983

[54] MARINE DRIVE WATER PUMP

[75] Inventors: James L. Bloemers, Fond du Lac; James M. Schiek, Omro; Michael E. Frazzell, Neenah; Michael A. Karls, Hilbert, all of Wis.

[73] Assignee: Brunswick Corporation, Skokie, Ill.

[21] Appl. No.: 408,508

[22] Filed: Aug. 16, 1982

Related U.S. Application Data

[63] Continuation of Ser. No. 146,528, May 5, 1980, abandoned.

[51] Int. Cl.[3] ..... F04D 5/00; F04D 29/42

[52] U.S. Cl. ..... 415/141; 415/213 R; 415/219 C; 418/154

[58] Field of Search ..... 415/141, 204, 200, 213 R, 415/213 A, 213 B, 214, 219 C; 418/46, 154

[56] References Cited

U.S. PATENT DOCUMENTS

| | | | |
|---|---|---|---|
| 2,536,374 | 1/1951 | Kincannon | 418/154 X |
| 2,899,902 | 4/1954 | Dandli et al. | 418/154 |
| 2,933,046 | 4/1960 | McCray | 418/154 |
| 3,001,480 | 9/1961 | Pike | 418/154 X |

*Primary Examiner*—Everette A. Powell, Jr.

*Attorney, Agent, or Firm*—Wm. G. Lawler, Jr.; Lewis L. Lloyd

[57] ABSTRACT

Marine drives having water cooled engines utilize a water pump mounted over the drive shaft and internal to the drive shaft housing to provide engine cooling, the pump having stamped metal housing parts and a flexible impeller.

5 Claims, 5 Drawing Figures

FIG. 1
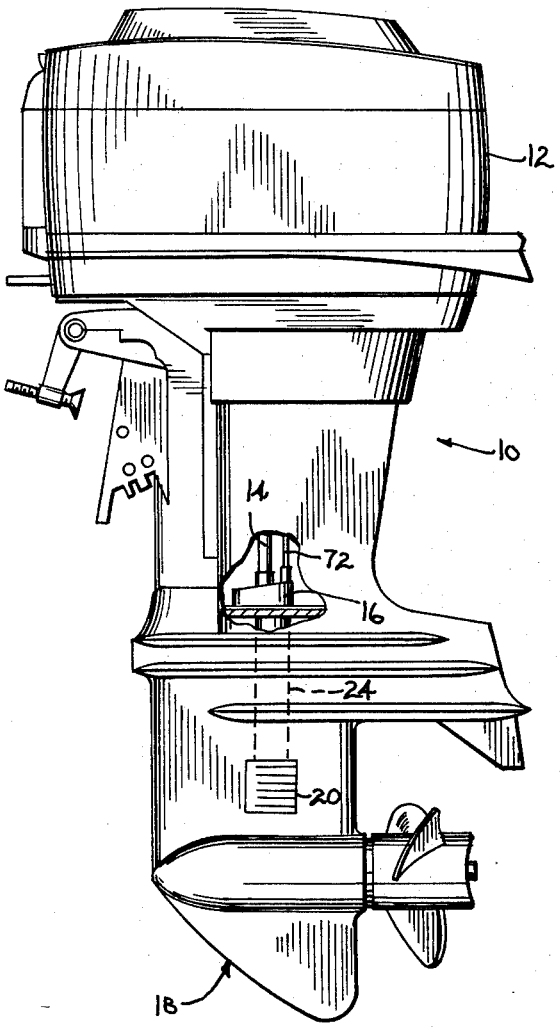
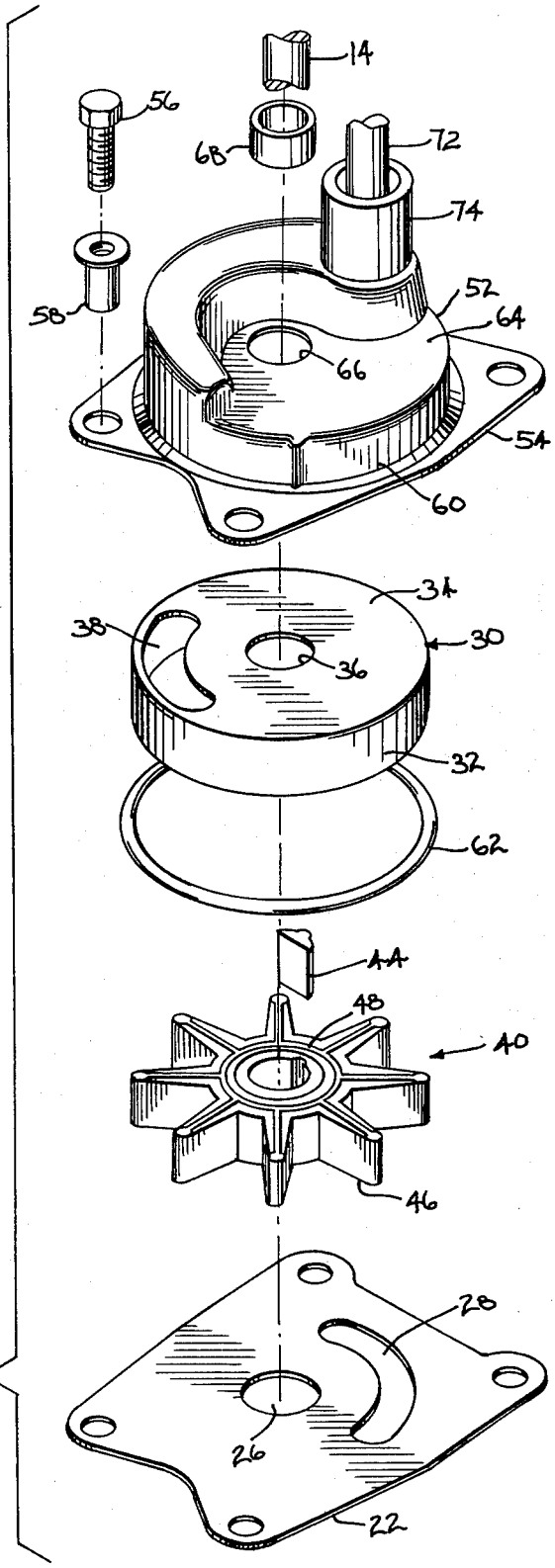
FIG. 3

MARINE DRIVE WATER PUMP

This application is a continuation of application Ser. No. 146,528, filed May 5, 1980, now abandoned.

BACKGROUND ART

One prior water pump used for cooling an outboard engine utilized a cast metal housing. The cast metal housing requires machining and is costly to manufacture. Also, the life of a cast brass or cast aluminum water pump is relatively low where the water contains sand and silt which will cause internal wear on the moving parts.

Another prior water pump is formed of a molded plastic housing. A metal liner is used within the plastic housing to provide abrasion resistance. Without the metal liner the plastic will wear through resulting in a water pump failure. A water pump failure may also result in engine failure.

DISCLOSURE OF INVENTION

The present invention provides an improved marine drive water pump that is simply and economically formed through the use of stamped metal parts. The parts are used without machining.

The improved water pump of the present invention includes:

a base plate mounted in the marine drive, the base plate having an eccentrically positioned drive shaft opening and a water inlet opening into the cooling water intake;

a cup-shaped impeller housing formed of deformed sheet metal having an end wall and a peripheral wall, the end wall having an eccentrically positioned drive shaft opening and a water outlet;

an impeller positioned in the impeller housing for propelling water received at the water inlet out the water outlet, the impeller having a central portion coupled to the drive shaft and a plurality of flexible impeller vanes extending outwardly from the central portion into contact with the peripheral wall of the impeller housing; and a shroud formed of deformed sheet metal fitting over the pump housing and secured to the base plate, the shroud forming a collecting chamber between the shroud and the impeller housing connecting the water outlet with a water discharge opening for the pump.

The improved water pump of the invention provides a water pump which has an increased service life and provides a superior silt resistance and dry running capability. The use of a metal stamping provides work hardening of the wear surfaces providing silt resistance and long flexible vanes on the impeller reduces wear on the impeller housing and results in longer impeller life.

The improved water pump of the invention provides in a single water pump all of the features necessary for a marine drive. These features are abrasion resistance, dry run survivability, reduced pressure loss with time, long flex life, excellent corrosion resistance, relatively low cost and excellent long-term adhesion of impeller rubber to its non-metal insert. In the improved water pump the long flexible vanes provide a low radial pressure thereby resulting in a reduced wear on the impeller housing, a longer flex life for the vanes, reduced pressure loss with respect to time and low friction. The low friction reduces the heat build up in the vanes and thereby permits better dry running of the water pump.

BRIEF DESCRIPTION OF DRAWINGS

FIG. 1 is a partially broken away side view of an outboard engine illustrating the water pump of the present invention.

FIG. 3 is an exploded view showing the components of the water pump shown in FIG. 1.

BEST MODE FOR CARRYING OUT THE INVENTION

Figure 2:
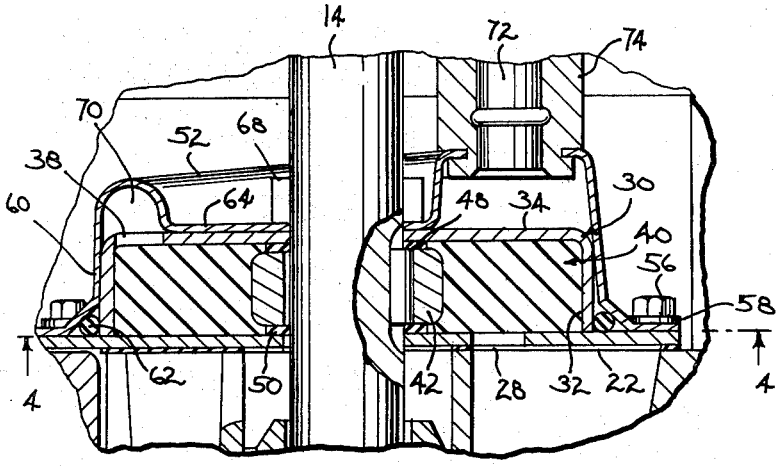
FIG. 2 is a cross-sectional view of the water pump shown in FIG. 1.

The marine drive is shown as an outboard engine 10 in FIG. 1. The outboard engine 10 includes a liquid cooled power head 12 that powers the drive shaft 14. The engine is cooled by water supplied by a pump 16. The propulsion unit 18 of the outboard engine 10 contains a water intake 20 that is within water when the propulsion unit 18 is in the operating position. The water pump 16 also may be mounted in the outboard engine 10 so that it is below the water line when the propulsion unit 18 is submerged.

The water pump 16 includes a base plate 22 that is mounted in the outboard engine 10 above the water intake conduit 24 and within the gear case housing. The base plate 22 is preferably formed of stainless steel sheet. The base plate 22 has an eccentrically positioned drive shaft opening 26. The base plate 22 includes a water inlet 28 spaced from the opening 26 and communicating with the water intake conduit 24.

A cup-shaped impeller housing 30 is positioned on the base plate 22 to connect with the water inlet 28. In the preferred embodiment the impeller housing 30 is formed from a stainless steel sheet to lend economy and corrosion resistance in the manufacture of the pump 16 and to provide hardening of desired areas of the resulting housing. The impeller housing 30 has a peripheral wall 32. An end wall 34 of the impeller housing 30 also contains an eccentrically positioned drive shaft opening 36. The wall 34 also includes a water outlet 38 spaced from the opening 36 and about oppositely displaced as shown in the figures from the water inlet 28 after the pump 16 is assembled.

Figure 4:
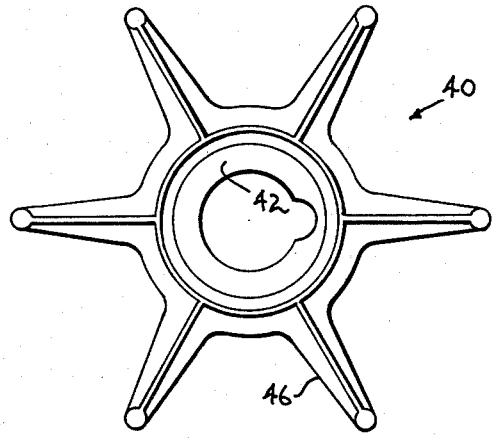
FIG. 4 is a plan view of the impeller of the water pump shown in FIG. 1.

The impeller 40 is positioned in the impeller housing 30. The impeller 40 is formed of a flexible material such as synthetic rubber compounded for temperature resistance. The preferred flexible material is nitrile elastomer. The impeller 40 includes a hub 42. The hub 42 is partly formed of fiber reinforced plastic to increase the corrosion resistance of the water pump 16 by avoiding a metal-to-metal contact between the impeller 40 and the drive shaft 14. The hub 42 is keyed to the drive shaft 14 by a key 44. A plurality of long, flexible impeller vanes 46 extend from the hub 42 of the impeller 40. In the preferred embodiment, as shown in FIG. 4, six such vanes are provided. The sealing rings 48 and 50 on either side of the hub 42 serve to seal the impeller housing 30 when the impeller 40 is located in the impeller housing 30 as shown in FIG. 2. The length and flexural properties of the vanes 46 and the inside diameter of the impeller housing 30 are selected so that a low radial pressure is exerted by each vane 46 on the peripheral wall 32 and low flexural stresses result in vanes 46. In the preferred embodiment the vane length is about 0.64 inches, the vane width at the hub 42 is about 0.2 inches and the ratio of the vane length to width is about 3.2:1. The hub outside diameter is about 1.04 inches and the inside diameter of the impeller housing 30 is about 2 inches and the ratio of the inside diameter of the impeller housing 30 to the outside diameter of the impeller hub 42 is greater than 1.9:1. The height of the vane parallel to drive shaft 14 is adjusted to obtain the desired capacity or volume flow of the water pump. In an alternative embodiment the vane length is about 0.85 inches, the vane width at the hub 42 is about 0.26 inches and the ratio of the vane length to width is about 3.3:1. The hub outside diameter is about 1.2 inches and the inside diameter of the impeller housing 30 is about 2.5 inches and the ratio of the hub outside diameter to the impeller housing inside diameter is about 2.1:1.

Figure 5:
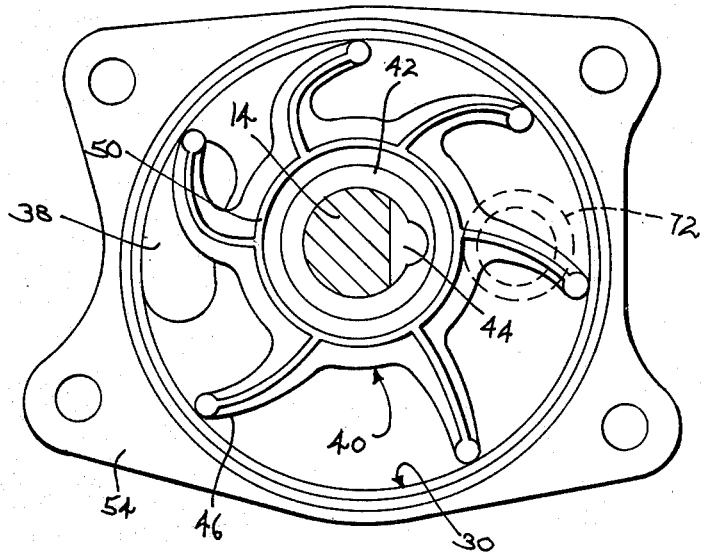
FIG. 5 is a view from beneath showing the impeller in the impeller housing.

In order to obtain the best flexure life of the vanes 46 it is required that the ratio of the vane length to width is equal to or greater than 3:1 and that the ratio of the inside diameter of the impeller housing 30 to the outside diameter of the impeller hub 42 is greater than 1.9:1. Since the impeller 40 is positioned in the impeller housing 30 eccentrically with the inside diameter of the housing 30 as previously described and as shown in FIG. 5 the outside diameter of the impeller 40 is larger than the inside diameter of the impeller housing 30. The ratio of the outside diameter of the impeller 40 to the inside diameter of the impeller housing 30 is in the range of 1.10:1 to 1.16:1. This is necessary to provide sealing between the end of the vanes and the peripheral wall 32.

It is also preferred that the tip width of the vanes be a minimum. In the preferred embodiment the tip width is about 0.12 inches and in the alternative embodiment the tip width is about 0.15 inches. The tip width is obtained by tapering the vane from its width at the hub to its extreme width at an included angle of about 8 to 9 degrees.

A shroud 52 fits over the impeller housing 30. In the preferred embodiment the shroud 52 is formed from a stainless steel sheet. The shroud 52 includes a flange 54 which contacts the base plate 22. The shroud 52 and the base plate 22 are secured to the propulsion unit 18 by the bolts 56. The bolts 56 are also formed of stainless steel to reduce corrosion. Non-metallic sleeves 58 are positioned over the bolts 56 and between the flange 54 to improve corrosion resistance. The shroud 52 has a peripheral wall 60 press-fitted with the peripheral wall 32 of the impeller housing 30. An O-ring 62 at the edge of the wall 60 of the impeller housing 30 seals the base plate 22 from the impeller housing 30 and a separate gasket between the base plate 22 and the shroud 52 seals the base plate 22 from the outboard engine 10. The transition between the wall 60 and the flange 54 may be suitably formed to accommodate an O-ring 62. The shroud 52 has an end wall 64 containing an eccentric opening 66 for inserting the drive shaft 14. A rotary slinger 68 is positioned over the drive shaft 14 on top of the water pump 16 to prevent entry of dirt and sand. When press-fitted the end wall 60 of the impeller housing 30 and the end wall 64 of the shroud 52 form a collecting chamber in the form of a arcuate passage 70 that connects the water outlet 38 of the impeller housing 30 with the water discharge pipe 72 through the connector 74. A water discharge pipe 72 connects the cooling water from the water pump 16 to the heat producing portions of the outboard engine 10 for cooling.

In operation the impeller housing 30 receives water through the water inlet 28 in the base plate 22. As shown in FIG. 5 the vanes 46 are sequentially flexed against the wall 32 of the impeller housing 30 by the eccentric rotation of the drive shaft 14 first to an increasing extent and then to a decreasing extent during each rotation of the impeller 40. The flexing of the vanes 46 and the resulting reduction in the volume between them and the peripheral wall 32 of the impeller housing 30 forces the water in the impeller housing 30 out water outlet 38, then through the passage 70 and into the water discharge pipe 72.

We claim:

1. In a marine drive having a water cooled engine rotating a drive shaft and having a cooling water intake, the improved water pump comprising:

(a) a base plate mounted in said marine drive, said base plate having an eccentrically positioned drive shaft opening and a water inlet opening into the cooling water intake, (b) a cup-shaped impeller housing formed of deformed sheet metal having an end wall and a peripheral wall, said end wall having an eccentrically positioned drive shaft opening and a water outlet, (c) an impeller positioned in said impeller housing for propelling water received at said water inlet out said water outlet, said impeller having a central hub coupled to the drive shaft and a plurality of flexible impeller vanes extending outwardly from said central hub into contact with the peripheral wall of said impeller housing, and (d) a shroud formed of deformed sheet metal fitting over said impeller housing to embrace the end wall and peripheral wall of said housing, said shroud being secured to said base plate, said shroud forming an arcuate collecting chamber between the shroud and the impeller housing to connect said outlet with a water discharge opening for said pump angularly displaced from said water outlet about the axis of the drive shaft.

2. The improved water pump according to claim 1 wherein said shroud abuts said base plate and wherein said pump includes sealing means between said shroud and said base plate.

3. The improved water pump according to claim 1 wherein said base plate, impeller housing, and shroud are formed of stainless steel.

4. The improved water pump according to claim 3 wherein said impeller housing has a work hardened peripheral wall.

5. The improved water pump according to claim 1 wherein said impeller vanes are dimensioned in length and width to create low flexural stresses in said impeller vanes, said length dimension being radial with respect to the drive shaft and said width dimension being normal to said length dimension and to the drive shaft; the ratio of the vane length to width being greater than 3:1 and the ratio of the inside diameter of the impeller housing to the outside diameter of the impeller hub is greater than 1.9:1.

* * * * *